United States Patent [19]

Griffith

[11] Patent Number: 4,955,795

[45] Date of Patent: Sep. 11, 1990

[54] SCROLL APPARATUS CONTROL

[75] Inventor: Russell W. Griffith, Troy, Ohio

[73] Assignee: Copeland Corporation, Sidney, Ohio

[21] Appl. No.: 287,912

[22] Filed: Dec. 21, 1988

[51] Int. Cl.[5] ..... F04B 49/02

[52] U.S. Cl. ..... 417/44

[58] Field of Search ..... 417/38, 44, 45; 418/2, 418/55 R

[56] References Cited

U.S. PATENT DOCUMENTS 4,551,069 11/1985 Gilmore ..... 417/13

4,696,628 9/1987 Kimura et al. ..... 418/15

4,767,293 8/1988 Caillat et al. ..... 418/55

FOREIGN PATENT DOCUMENTS 0156990 8/1985 Japan ..... 418/2

*Primary Examiner*—Leonard E. Smith

*Assistant Examiner*—David W. Scheuermann

*Attorney, Agent, or Firm*—Harness, Dickey & Pierce

[57] ABSTRACT

A scroll-type machine having a control arrangement which acts to disable the machine when there is an abnormal pressure in one of the scroll fluid pockets, thereby preventing damage to the machine upon reverse rotation or low system charge.

12 Claims, 1 Drawing Sheet

FIG. 1.
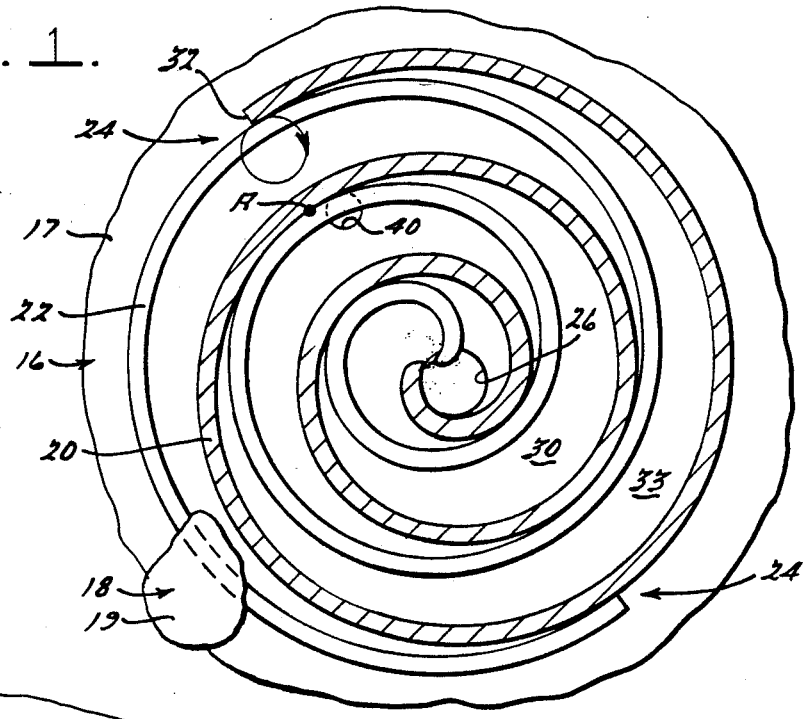
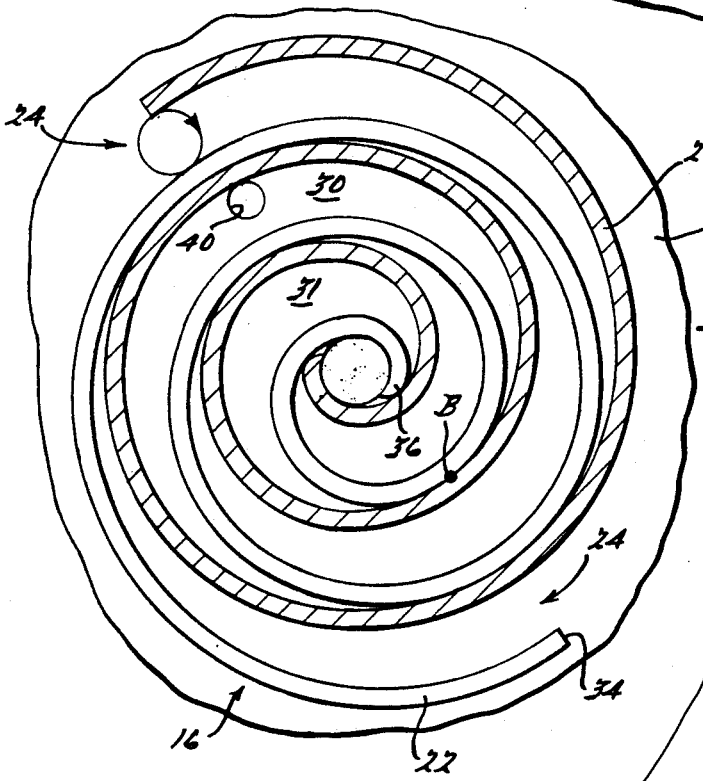
FIG. 2.
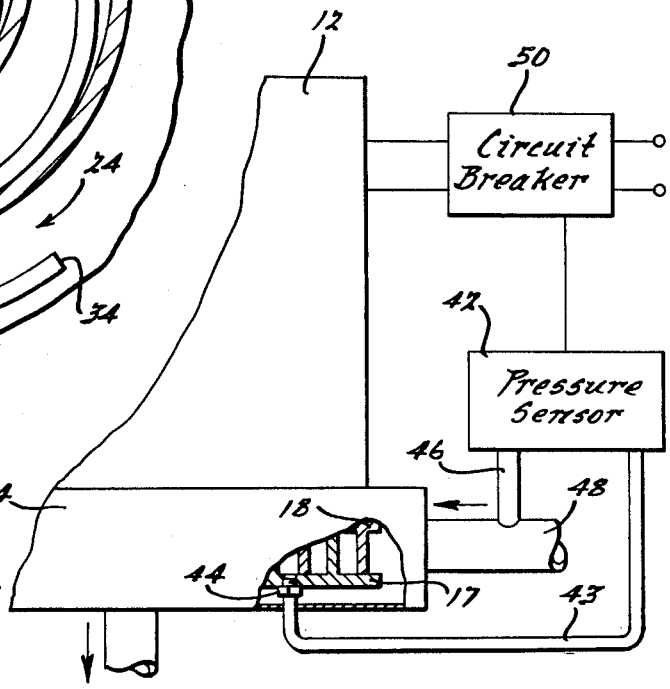
FIG. 3.

SCROLL APPARATUS CONTROL

BACKGROUND AND SUMMARY OF THE INVENTION

This invention relates generally to scroll compressors and more particularly to a control arrangement therefor for sensing low system gas charge and/or a reverse rotation condition.

Scroll machines generally comprise first and second scroll members, each comprising ar end plate which is provided with an upstanding spiral wrap. The scroll members are interleaved, with the flanks of the wraps engaging one another at substantially line contacts and the tips of each wrap sealingly engaging the end plate of the other scroll member so as to define travelling pockets of varying volume in which gas is compressed as one scroll member is caused to orbit relative to the other. Suction gas is communicated to the outermost compression chamber near the radially outward-most portion of the wraps and discharged through a discharge port centrally of the wraps. A motorized drive mechanism causes the orbiting scroll to orbit thereby decreasing the volume of the pockets and increasing the pressure of the compressed gas as it is progressively moved towards the discharge port. Exemplary of such an apparatus is U.S. Pat No. 4,767,293 entitled "Scroll Type Machine", the disclosure thereof being specifically incorporated herein by reference.

When a scroll machine works as a compressor, the pockets are pressurized thereby causing the scroll members to be forced apart, however when orbited in the reverse direction the machine acts as a vacuum pump and therefore the scroll members are drawn together. The latter can be caused when the motor is improperly wired, or by a power interrupt, and the resulting vacuum can cause damage to the scroll members because of the excessive wear which occurs. The possibly destructive vacuum condition can also occur when a serviceman runs the compressor with the suction blocked, a not uncommon occurrence.

Another condition which can result in excessive wear is a loss of charge, particularly in a refrigerant compressor, which results from the installation of insufficient refrigerant into the system or from refrigerant leakage.

It is therefore a primary object of this invention to provide a control for a scroll-type machine which overcomes the aforesaid problems in a simple and inexpensive manner, and which does not result in any significant loss of efficiency.

Additional advantages and features of the present invention will become apparent from the subsequent description and the appended claims taken in conjunction with the accompanying drawings.

BRIEF DESCRIPTION OF THE DRAWINGS

FIGS. 1 and 2 are schematic horizontal cross-sectional views of a portion of a scroll compressor assembly including a pair of intermeshed scroll members, illustrated at two different stages of compression, the view being taken from the middle of the assembly and looking toward the non-orbiting scroll member; and FIG. 3 shows a schematic diagram of a control arrangement which can be used in conjunction with the sensing means of the present invention in order to deenergize the compressor when there is a loss of refrigerant charge or a vacuum is being generated.

DETAILED DESCRIPTION OF THE PREFERRED EMBODIMENT

Although the principles of the present invention may be applied to many different types of scroll machine, they are described herein for exemplary purposes embodied in a hermetic scroll-type compressor, and particularly one which has been found to have specific utility in the compression of refrigerant for air conditioning, heat pump and/or refrigeration systems.

A hermetic scroll compressor 10 comprises a shell (not shown) for enclosing a driving electric motor 12 connected by a crankshaft (not shown) to a scroll assembly 14 comprising a pair of interleaved scroll members 16 and 18 including end plates 17 and 19 having respective spiral wraps 20 and 22 projecting therefrom. In the illustration shown, scroll members 16 and 18 are, respectively, non-orbiting and orbiting. The scroll members receive refrigerant gas at radially outward suction inlets 24 and discharge the refrigerant through a discharge port 26 in end plate 17. The crankshaft is operative to drive one of the scroll members in an orbit relative to the other scroll member, i.e. orbiting scroll member 18, such that the wraps define a plurality of sealed compression pockets or chambers, such as pockets 30 and 31, which travel along a spiralling path generally radially inwardly while the volume of the pocket is progressively decreased, thereby compressing the fluid therein. A compressor of this type, to which the invention is applicable is fully disclosed in assignee's aforementioned patent. Except for the sensing means of the present invention the scroll machine is in all ways of known design and operation.

FIG. 1 shows a position wherein outward radial tip 32 at the end of the non-orbiting scroll wrap 20 has just sealed a compression chamber 33 which extends around to approximately point A. A similar outward radial tip 34 at the end of wrap 22 has just sealed against wrap 20. FIG. 2 shows the scroll assembly 180° crank angle later wherein the inner tip 36 of orbiting scroll wrap 22 is ready to separate from wrap 20 and place fluid in compression chamber 31 in communication with discharge opening 26, the beginning of chamber 31 being indicated at point B. The outward radial tips 32 and 34 allow a new charge of refrigerant to be received in compressor assembly 14. Further orbiting of scroll member 18 will cause continuing discharge in the usual manner.

In accordance with this invention, a unique arrangement is provided for sensing an internal chamber pressure in scroll machine and, depending on the application, disabling the driving motor so that the compressor cannot be operated if the pressure indication is above or below a predetermined value. In this regard, either absolute chamber pressure or the differential between the chamber pressure and suction pressure can be sensed.

Referring to the drawings, a pressure sensing port 40 is located in end plate 17 in a position to sense the pressure in chamber 30. Port 40 is preferably located just inwardly of point A because that is where the maximum vacuum will be developed in a reverse rotation situation, and yet is a point which will never see suction pressure. Port 40 can be located further angularly inwardly if desired, such as to increase response time, but cannot be located further inwardly than point B because it should never see discharge pressure. Preferably the port is located in the range between approximately 10° inwardly of point A and approximately 10° outwardly of point B. This places the port in a range slightly more than 360° from the inner and outer ends of wrap 20.

An electrical output pressure sensor 42 is provided which, depending on the application, is responsive to the absolute pressure in chamber 30 via a tube 43 and fitting 44, connected to end plate 17 in fluid communication with port 40; or to the differential pressure between port 40 and suction pressure via a tube 46 in communication suction line 48 (for example). A line circuit breaker 50 is electrically connected to motor 12 and receives a signal, from the pressure sensor 42. Should the signal be of a value indicating that the pressure in chamber 30 is below a predetermined value, then the circuit breaker will act to disable the electrical connection to motor 12.

If during compressor operation the absolute pressure of pocket 30 goes below a predetermined value (determined by the application), then the compressor is either running backwards or the system is low on refrigerant charge. If the measured pressure is lower than suction pressure during compressor operation, then the compressor is running backwards. The predetermined value is a matter of choice, but is preferably less than the minimum pressure normally encountered under design operating conditions.

In the case of the compressor running backwards, the normal discharge valve or discharge flow check valve on the scroll machine will prevent backflow into the compressor as refrigerant in the pockets is forced out through the normal suction openings of the compressor due to reverse rotation. As a result, the internal volume of the compressor between point A on the wrap and the discharge check valve will be quickly evacuated to a very low pressure, certainly a pressure below suction pressure and also below any pressure the system would normally experience. Thus, an abnormally low chamber pressure can be used to detect reverse rotation of the compressor.

With regard to sensing low charge in the system (i.e., inadequate refrigerant being supplied by inlet 24 to the scroll assembly), a low system charge will result in abnormally low suction pressure during compressor operation. Compressing an abnormally low suction pressure results in an abnormally low pressure in chamber 30. Thus, sensing a chamber pressure below some preset value which is below a normally expected pressure level in the chamber would indicate a low system charge.

While it is apparent that the preferred embodiment of the invention disclosed is well calculated to provide the advantages and features above stated, it will be appreciated that the invention is susceptible to modification, variation and change without departing from the proper scope or fair meaning of the subjoined claims from the proper scope or fair meaning of the subjoined claims.

What I claim is:

1. A scroll machine, comprising:

(a) a scroll assembly comprising a pair of scroll members, each including an end plate and an upstanding spiral wrap, said spiral wraps intermeshing with one another so as to define a plurality of packets whereby orbiting of one scroll member with respect to the other scroll member will cause said pockets to progressively change in volume:

(b) means defining an inlet chamber for supplying inlet fluid to said scroll assembly;

(c) drive means for causing one of said scroll members to orbit with respect to the other scroll member; and (d) control means responsive to a control pressure for deenergizing said drive means when said pressure is of a value indicating an undesirable machine condition, said control pressure being the pressure of fluid in one of said pockets, said control pressure being sensed at a point on a scroll member which is more than 360° from the outer end of the wrap which defines the outside of said one of said pockets.

2. A scroll machine, comprising:

(a) a scroll assembly comprising a pair of scroll members, each including an end plate and an upstanding spiral wrap, said spiral wraps intermeshing with one another so as to define a plurality of pockets whereby orbiting of one scroll member with respect to the other scroll member will cause said pockets to progressively change in volume;

(b) means defining an inlet chamber for supplying inlet fluid to said scroll assembly;

(c) drive means for causing one of said scroll members to orbit with respect to the other scroll member; and (d) control means responsive to a control pressure for deenergizing said drive means when said control pressure is of a value indicating an undesirable machine condition, said control pressure being the pressure of fluid in one of said pockets and being sensed at a point which never sees inlet pressure.

3. The scroll machine as recited in claim 2, wherein said control means deenergizes said drive means when said control pressure drops below a predetermined value.

4. The scroll machine as recited in claim 3, wherein said predetermined value is slightly less than the minimum pressure expected in said pocket under normal operating conditions.

5. A scroll machine, comprising:

(a) a scroll assembly comprising a pair of scroll members, each including an end plate and an upstanding spiral wrap, said spiral wraps intermeshing with one another so as to define a plurality of pockets whereby orbiting of one scroll member with respect to the other scroll member will cause said pockets to progressively change in volume;

(b) means defining an inlet chamber for supplying inlet fluid to said scroll assembly;

(c) means defining an outlet port for discharging fluid from said machine;

(d) drive means for causing one of said scroll members to orbit with respect to the other scroll member; and (e) control means responsive to a control pressure for deenergizing said drive means when said control pressure is of a value indicating an undesirable machine condition, said control pressure being the pressure of fluid in one of said pockets and being sensed at a point which never sees discharged fluid at outlet pressure.

6. A scroll machine, comprising:

(a) a scroll assembly comprising a pair of scroll members, each including an end plate and an upstanding spiral wrap, said spiral wraps intermeshing with one another so as to define a plurality of pockets whereby orbiting of one scroll member with respect to the other scroll member will cause said pockets to progressively change in volume, each said pocket moving from a first open condition in which it receives inlet fluid to a closed condition in which the pressure of the fluid therein changes with pocket volume, and then to a second open condition in which fluid is discharged;

(b) means defining an inlet chamber for supplying inlet fluid to said scroll assembly;

(c) drive means for causing one of said scroll members to orbit with respect to the other scroll member; and (d) control means responsive to a control pressure for deenergizing said drive means when said control pressure is of a value indicating an undesirable machine condition, said control pressure being the pressure of fluid in one of said pockets and being sensed at a point in said pocket just after said pocket closes.

7. The scroll machine as recited in claim 6, wherein said point is approximately 10° after said pocket closes.

8. A scroll machine, comprising:

(a) a scroll assembly comprising a pair of scroll members, each including an end plate and an upstanding spiral wrap, said spiral wraps intermeshing with one another so as to define a plurality of pockets whereby orbiting of one scroll member with respect to the other scroll member will cause said pockets to progressively change in volume, each said pocket moving from a first open condition in which it receives inlet fluid to a closed condition in which the pressure of the fluid therein changes with pocket volume, and then to a second open condition in which fluid is discharged;

(b) means defining an inlet chamber for supplying inlet fluid to said scroll assembly;

(c) drive means for causing one of said scroll members to orbit with respect to the other scroll member; and (d) control means responsive to a control pressure for deenergizing said drive means when said control pressure is of a value indicating an undesirable machine condition, said control pressure being the pressure of fluid in one of said pockets and being sensed at a point in said pocket just before said pocket opens to said second open condition.

9. The scroll machine as recited in claim 8, wherein said point is approximately 10° before said pocket closes.

10. A scroll machine, comprising:

(a) a scroll assembly comprising a pair of scroll members, each including an end plate and an upstanding spiral wrap, said spiral wraps intermeshing with one another so as to define a plurality of pockets whereby orbiting of one scroll member with respect to the other scroll member will cause said pockets to progressively change in volume;

(b) means defining an inlet chamber for supplying inlet fluid to said scroll assembly;

(c) drive means for causing one of said scroll members to orbit with respect to the other scroll member; and (d) control means responsive to a control pressure for deenergizing said drive means when said control pressure is of a value indicating an undesirable machine condition, said control means sensing inlet pressure and the pressure of fluid in one of said pockets, said control pressure being the pressure differential between the pressure of fluid in said one of said pockets and said inlet pressure.

11. The scroll machine as recited in claim 10, wherein said control means deenergizes said drive means when said control pressure drops below a predetermined value.

12. The scroll machine as recited in claim 10, wherein said control means deenergizes said drive means when said control pressure is approximately zero pressure differential.

* * * * *

UNITED STATES PATENT AND TRADEMARK OFFICE

CERTIFICATE OF CORRECTION

PATENT NO. : 4,955,795

DATED : September 11, 1990

INVENTOR(S) : Russell W. Griffith

It is certified that error appears in the above-identified patent and that said Letters Patent is hereby corrected as shown below:

Column 1, line 11, "ar" should be -- an --.

Column 3, lines 56 and 57, after "claims" delete -- from the proper scope or fair meaning of the subjoined claims --.

Column 3, line 63, Claim 1, "packets" should be -- pockets --.

Column 3, line 66, Claim 1, ":" should be -- ; --.

Signed and Sealed this

Third Day of March, 1992

*Attest:*

HARRY F. MANBECK, JR.

*Attesting Officer*

*Commissioner of Patents and Trademarks*